US005120952A

United States Patent [19]

Geisselmann et al.

[11] Patent Number: 5,120,952

[45] Date of Patent: Jun. 9, 1992

[54] DEVICE FOR DETECTING AND COUNTING WARP AND WEFT THREADS IN A FEED DEVICE OF AN INDUSTRIAL SEWING MACHINE

[75] Inventors: Heribert Geisselmann, Stutensee; Manfred Frank, Ottersweier, both of Fed. Rep. of Germany

[73] Assignee: Durkopp Adler Aktiengesellschaft and PFAFF Industriemaschinen GmbH, Fed. Rep. of Germany

[21] Appl. No.: 536,598

[22] PCT Filed: Jan. 18, 1989

[86] PCT No.: PCT/EP89/00049

§ 371 Date: Jun. 28, 1990

§ 102(e) Date: Jun. 28, 1990

[87] PCT Pub. No.: WO89/06715

PCT Pub. Date: Jul. 27, 1989

[30] Foreign Application Priority Data

Jan. 21, 1988 [DE] Fed. Rep. of Germany ..... 3801623

[51] Int. Cl.[5] ..... H01J 40/14

[52] U.S. Cl. ..... 250/222.2; 112/306

[58] Field of Search ..... 250/222.2, 237 R, 56; 377/17, 18; 112/306, 121.12, 278, 272, 413

[56] References Cited

U.S. PATENT DOCUMENTS 3,633,037 1/1972 Langenbeck ..... 356/354
4,964,352 10/1990 Yokoe et al. ..... 112/121.12
4,999,488 8/1991 Sollars ..... 250/222.2

*Primary Examiner*—David C. Nelms
*Assistant Examiner*—Que T. Le
*Attorney, Agent, or Firm*—Laff, Whitesel, Conte & Saret

[57] ABSTRACT

In a device for ascertaining the actual feed transmittted by an feed device of an industrial sewing machine to a material to be sewn, in which the number of the threads moved across a sensor arrangement is counted and the feed is calculated from the previously detected thread density, it is provided, for obtaining an exact thread count which is as independent as possible of the orientation of the sewn web, to place ahead of the photocell (10) of the sensor arrangement a rotating slit diaphragm (7) with at least one radially extending parallel limited slit (8). Preferably a second, rotationally adjustable, but fixed slit diaphragm (5) is provided, having slits (6) opening across a set angular sector, the rotatitng slit diaphragm (7) having a larger number of slits (8). Because of this the required rpm of the slit diaphragm (7) can be reduced. To avoid errors caused by the pattern of the material it is possible to operate in the relatively longer wave infrared spectrum.

7 Claims, 2 Drawing Sheets

DEVICE FOR DETECTING AND COUNTING WARP AND WEFT THREADS IN A FEED DEVICE OF AN INDUSTRIAL SEWING MACHINE

TECHNICAL FIELD

The invention relates to a device for ascertaining the actual feed transmitted by a feed device of an industrial sewing machine to the material to be sewn, in which warp and weft threads located subsequent to each other in the direction of sewing are detected and counted during the feed of the material to be sewn by means of an optical sensor device having a light source and a photo cell, a signal corresponding to the actual feed being formed from this signal and from the predetermined thread density of the specific material to be sewn.

STATE OF THE ART

When sewing one or several layers of material on an industrial sewing machine, a difference between the set and actual feed occurs with each stitch, which is the result of the slippage between the feed device and the material, and which accumulates until the end of the seam. The result is an undefinable result of the sewing, which makes the production of high-quality seams more difficult.

Accordingly, it has already been tried, as described in German Patent DE-PS 23 61 375, to determine the actual feed with the aid of sensing wheels, in which case it is also possible that an error in the form of slippage between the respective layer of work and the sensing wheel may occur.

According to German Published, Non-examined Application DE-OS 35 25 028 a method is known in which marks, either already present or placed at random places of the respective work pieces, are scanned by means of contact-free sensor devices and where the sum of the pulses between the successive scans of each mark is compared with a set number of pulses corresponding to the length of the stitch and the distance between the scanned locations.

Thus this known method requires that corresponding marks or markings, e.g. in the form of a fabric design usable for this, be already present, which applies only to some materials to be worked. Otherwise, markings have to be applied, the application of markings to the individual layers of material to be sewn being laborious and time-consuming and thus economically hardly justifiable, while the application of usable markings on stacks of material to be sewn, in a way that would allow dependable recognition, leads to considerable technological problems.

Furthermore, it should be borne in mind that because of the requirements of modern sewing technology relatively strict standards must be applied to the quality of the method of measuring to be used, where consideration should be given to the fact that the material may be stretched or bunched in the course of the process steps and that warping or material stretching might occur during sewing because of the elasticity of the material. With high-quality materials, maximum material speeds up to 1,200 mm/s, maximum number of stitches up to 10,000 stitches/min. and a maximum shift of 0.3% of the sewn length of material are the goal.

A device according to the species is known from WO 86/00347. However, in connection with this known device it is an important prerequisite for the correct detection of the shift that the threads to be counted extend at exactly right angles to the direction of feed; during actual sewing operations, this prerequisite is virtually unattainable, because of the high speeds and in the light of the material-specific differences of the individual threads in regard to their intended orientation.

DESCRIPTION OF THE INVENTION

Based on the foregoing it is an object of the invention to design a device of the type mentioned above in such a way that a very exact detection of the feed becomes possible in connection with the major portion of commercially available materials used in sewing, to a large degree regardless of the orientation of the warp and weft threads of the material to be sewn.

In accordance with the invention this object is attained in that a rotating slit diaphragm having at least one radially extending and parallel limited slit is placed in front of the receiver cell, the rpm of the slit diaphragm being at least high enough so that during a feed corresponding to one-half of the distance between two threads adjacent to each other in the direction of feed a slit of the slit diaphragm lies at least once parallel to the direction of the threads to be counted, and an intensity threshold being provided in the evaluation device so that a counting pulse is triggered only upon crossing of the intensity threshold. Such a rotating slit diaphragm assures that in the course of a half rotation of the diaphragm, i.e. while covering an angular sector of 180°, in at least one instance a slit of the slit diaphragm is parallel to the threads to be counted. This leads to the light reflection of light transmission having at this point in time a clear maximum or minimum value, so that it is possible to trigger a definite counting pulse by means of an intensity threshold pre-selected in the evaluation device. Thus the method does not depend on whether a transmitted light or a reflection method is used. Since reflection methods do not present problems even with multiple layers of material to be sewn, normally the light source(s) above the material to be sewn will be installed slightly offset to the optical axis of an optical image device disposed above the light sources, which displays the material to be sewn or the threads of the material to be sewn onto the slit diaphragm.

By means of the method of the invention the situation in which, if the threads to be counted clearly diverge from a direction which is vertical to the direction of feed, either no maximum values which can be evaluated or no reliably usable signals are obtained, is avoided.

Further, it is assured that each individual thread moved past the sensor device leads to the triggering of a counting signal, so that the feed is correctly detected.

The rpm to be set accordingly depends on the set feeding speed and the thread density of the material to be processed, the resolution capability of course depending on the thickness of the individual threads.

In order to obtain rpm of the slit diaphragm which can be realized without technical problems even with relatively high feeding speeds it may be provided that a plurality of slits is disposed on the rotating slit diaphragm and that a rotationally adjustable, fixed slit diaphragm is placed behind it, the slits of which widen so they cover a small radial angular sector. Preferably, the slits of the fixed slit diaphragm cover an angular sector of approximately 10°. Advantageously it is provided, for example, that the fixed slit diaphragm has four slits disposed in the form of a cross and the rotating slit diaphragm has nine slits disposed at equal angular distances.

The fixed diaphragm is set in such a way that, within the range of divergences from the ideal orientation, the warp and weft threads fall within the angular sector set by the radially widening slits of this diaphragm. With this disposition a counting signal is emitted each time a slit of the rotating slit diaphragm overlaps the direction in which a thread to be counted, which is moved along below a slit of the fixed slit diaphragm, is oriented.

Although it is necessary to pre-set the fixed diaphragm or to place it behind if the direction of sewing is changed, it is nevertheless possible because of this to reduce the required rpm of the rotating slit diaphragm reversely proportional to the number of slits provided on it.

The preferred design discussed above of covering an angular section of 10° takes into consideration the angular tolerances measured in connection with different samples of material to be sewn. The number of nine such slits is the result of presetting such an angular section to 10°, together with the requirement that only one slit of the rotating slit diaphragm is to fall into a slit of the fixed slit diaphragm.

Because of this, the rpm in connection with a desired maximum feeding speed can be limited to 600 rpm/s, instead of an rpm value of 5,000 rpm/s. Furthermore, this design results in a simplified signal reception, because at the same time the rpm are reduced, the required band width of the signal amplifier can be reduced.

In a further improvement of the invention it is provided to make the light source an infrared light source and the photocell an infrared receiver. The light source preferably operates in a wave length range above 2,200 nm.

Operating in the range of the infrared spectrum, in particular in the range of the relatively longer wave length infrared spectrum, mistakes are avoided which might occur because of the coloration of the threads to be scanned, in particular in connection with a strongly contrasting design, because the color sensitivity is neutralized.

BRIEF DESCRIPTION OF THE DRAWINGS

Further characteristics, advantages and details of the invention ensue from the description below of a preferred embodiment by means of the drawing. Shown are in FIG. 1 a schematic design of a device according to the invention, FIGS. 2*a* to *d* illustrations of the relative positions of the two slit diaphragms in relation to each other and to the position of the warp and weft threads of the respective material to be sewn, and FIG. 3 a schematic top view of the two slit diaphragms.

BEST MODES OF ATTAINING THE INVENTION

Figure 1:
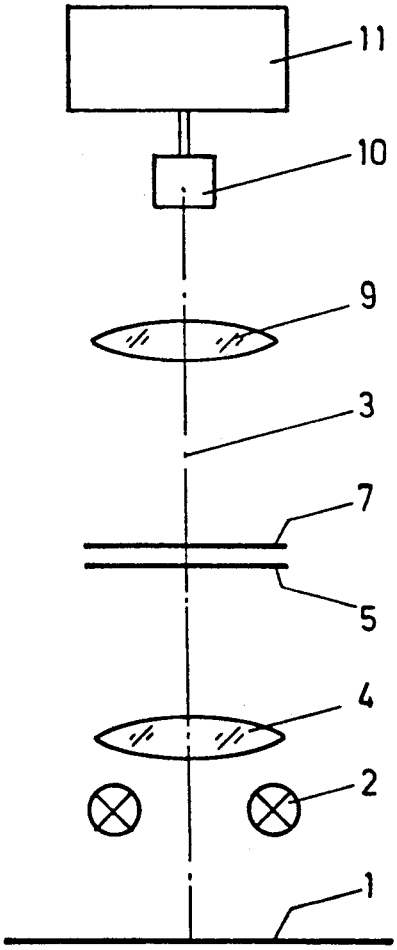
Figure 3:
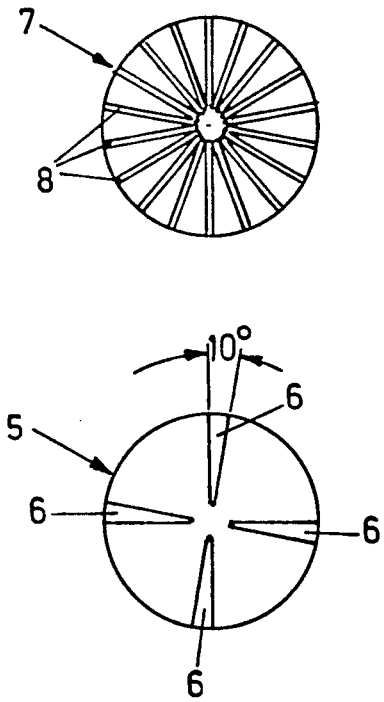
Figure 2A:
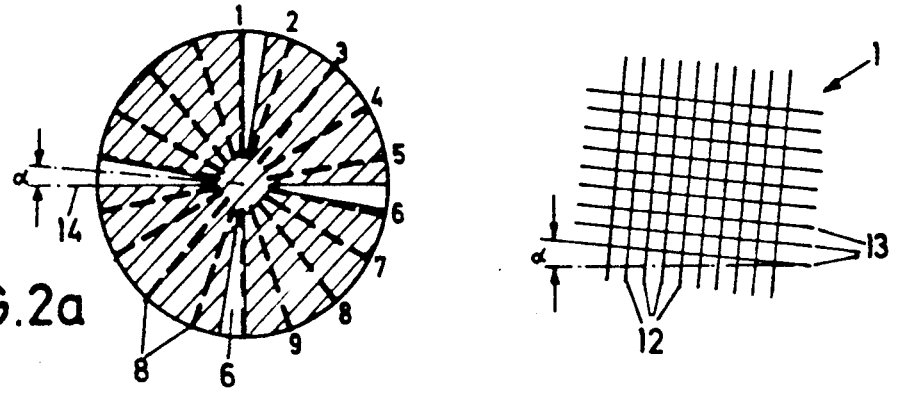
Figure 2B:
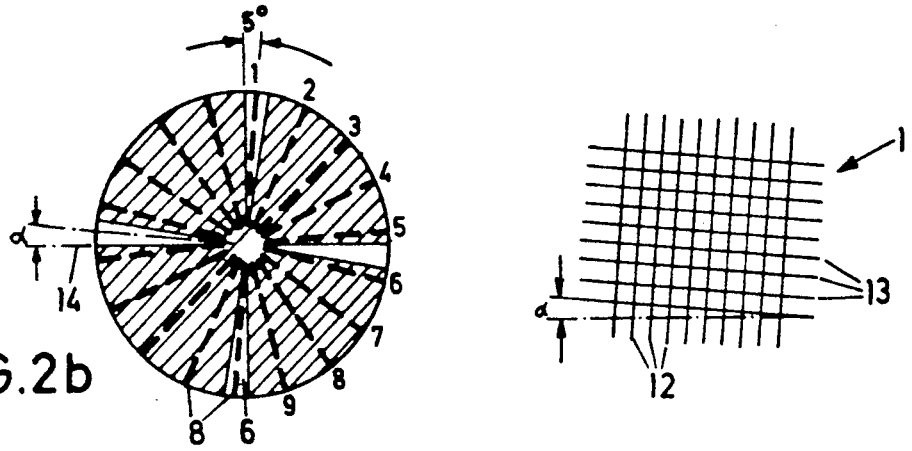
Figure 2C:
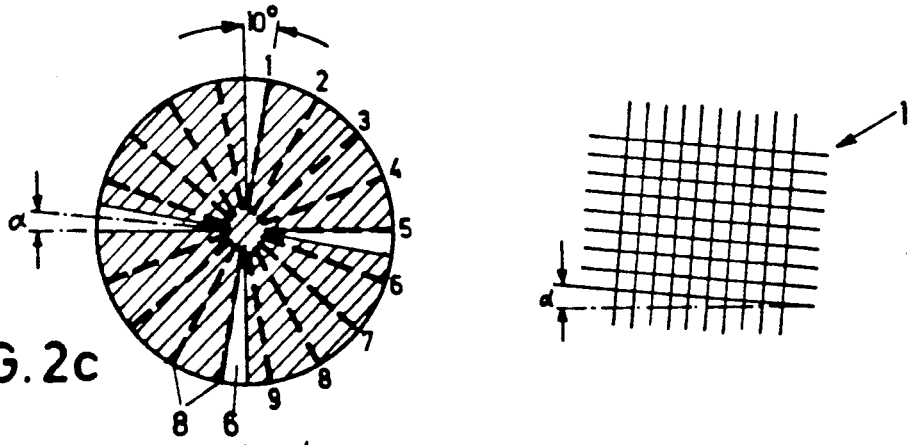
Figure 2D:
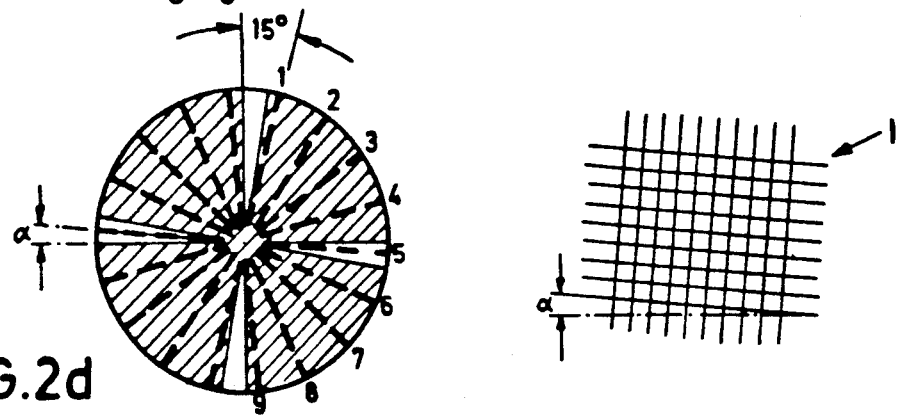

The design of a device in accordance with the invention is shown schematically in FIG. 1. It comprises two light sources 2 disposed above the material to be sewn 1, which is moved along a material support not shown in detail. The light sources 2 are disposed laterally to the optical axis 3. The light reflected by the material to be sewn 1 is displayed on a lower, fixed disk 5 via an imaging arrangement 4, schematically indicated as a lens. In the exemplary embodiment, the disk 5 has four crosswise arranged slits 6 (see. FIG. 3).

Each slit 6 radially widens outwardly, starting at the center of the circular diaphragm 5, and covers in this way an angular sector of approximately 10°.

A rotating slit diaphragm 7 is disposed above the slit diaphragm 5 which, in the exemplary embodiment, has nine parallel limited, radially extending slits 8.

The slits 6 or 8 of the diaphragms 5 or 7 are imaged by a further imaging arrangement 9, also shown in the form of a lens, onto a photocell 10, behind which an evaluation arrangement 11, only shown as a block, is placed.

In the actual realization it may be provided for reasons of space that the imaging arrangement comprise an optical wave guide, so that the photocell 10 and the evaluation arrangement 11 can be positioned away from the actual point of measuring. To the extent the term "photocell" has been used above, it is understood in the widest sense to be a light-sensitive element which is capable to generate an electric signal corresponding to the intensity of the received light.

The operation of a device in accordance with the invention, shown schematically in FIG. 1, will be described in detail below by means of FIG. 2, and it is assumed that the material to be sewn and which is to be scanned consists of equidistant warp threads 12 and weft threads 13 extending vertically to each other.

The warp threads 12 should extend about vertically to the direction of sewing, which is defined by the straight line 14. It is furthermore assumed that the expected deviation of the angle $\alpha$ of the actual course of the weft threads 13 or the warp threads 12 from the direction of sewing, i.e. the straight line 14, maximally corresponds to an angular sector of 10°, which is set by the slits 6. The slits 6 or the angular sector covered by them is shown in white in FIG. 2, while the area covered by the diaphragm 5 is shown by cross-hatching. The slits 8 of the diaphragm 7 are schematically shown by dashed lines and are indicated at the edge by the numbers 1 to 9.

Prior to the start of measuring, the lower diaphragm 5 is turned until the aimed for intersection made up of warp and weft threads 12 and 13 appears in the transmission range of this lower diaphragm 5. A follow-up device of the diaphragm 5 prevents leaving this range. The upper diaphragm 7 rotates at an rpm of, e.g., 600 rpm/s, so that in this way only one slit 8 of the slit diaphragm 7 overlaps a slit 6 of the slit diaphragm 5, by means of which a defined maximum or minimum of the reflected light is detected at this moment by the evaluation arrangement 11. In this manner a reliable count of the number of the weft or warp threads 13 or 12, which are moved along by means of the feed device of the sewing machine, becomes possible, even if these threads extend within a tolerance range or if the feed does not exactly take place parallel to the thread direction.

Independently of the exemplary embodiment described above, it is possible to derive a reliable, clearly readable count signal even if only the rotating diaphragm 7 is used, and in this case completely independent of the orientation of the warp threads 12 and weft thread 13.

We claim:

1. Device for ascertaining the actual feed transmitted by a feed device of an industrial sewing machine to the material to be sewn, in which warp and weft threads located subsequent to each other in the direction of sewing are detected and counted during the feed of the material to be sewn by means of an optical sensor device having a radiation source and a receiver cell, a signal corresponding to the actual feed being formed in an evaluation device from this signal and from the predetermined thread density of the specific material to be sewn, characterized in that a rotating slit diaphragm (7) having at least one radially extending and parallel limited slit (8) is placed in front of the receiver cell (10), the rpm of the slit diaphragm (7) being at least high enough so that during a feed corresponding to one-half of the distance between two threads (12 or 13) adjacent to each other in the direction of feed slit (8) of the slit diaphragm (7) lies at least once parallel to the direction of the treads (12 or 13) to be counted, and an intensity threshold being provided in the evaluation device (11) so that a counting pulse is triggered only upon crossing of the intensity threshold.

2. Device in accordance with claim 1, characterized in that a plurality of slits (8) is disposed on the rotating slit diaphragm (7) and that a rotationally adjustable, fixed slit diaphragm (5) is placed ahead of it, the slits (6) of which widen so they cover a small radial angular sector.

3. Device in accordance with claim 2, characterized in that the slits (6) of the fixed slit diaphragm (5) cover an angular sector of approximately 10°.

4. Device in accordance with claim 3, characterized in that the fixed slit diaphragm (5) has four crosswise disposed slits and the rotating slit diaphragm (7) has nine slits (8).

5. Device in accordance with claim 1, characterized in that the rotating slit diaphragm (7) is formed by at least one optical cross section converter with a slit-shaped entry cross section.

6. Device in accordance with claim 1, characterized in that the light source (4) is an infrared light source and the photocell (10) is an infrared receiver.

7. Device in accordance with claim 6, characterized in that the light source (2) operates at a wave length range above 2,200 nm.

* * * * *